US009796453B2

(12) United States Patent
Clarkson

(10) Patent No.: US 9,796,453 B2
(45) Date of Patent: Oct. 24, 2017

(54) MOORING STRUCTURE MOUNTED ON A VESSEL

(71) Applicant: WINDCAT WORKBOATS LIMITED, Poulton-le-Fylde, Lancashire (GB)

(72) Inventor: Neil M. Clarkson, Poulton-le-Fylde (GB)

(73) Assignee: WINDCAT WORKBOATS LIMITED, Poulton-le-Fylde, Lancashire (GB)

( * ) Notice: Subject to any disclaimer, the term of this patent is extended or adjusted under 35 U.S.C. 154(b) by 0 days.

(21) Appl. No.: 14/381,567

(22) PCT Filed: Feb. 3, 2014

(86) PCT No.: PCT/GB2014/050287
§ 371 (c)(1),
(2) Date: Aug. 27, 2014

(87) PCT Pub. No.: WO2014/118570
PCT Pub. Date: Aug. 7, 2014

(65) Prior Publication Data

US 2015/0307160 A1 Oct. 29, 2015

(30) Foreign Application Priority Data

Feb. 4, 2013 (GB) ..... 1301949.2

(51) Int. Cl.
*B63B 21/00* (2006.01)
*B63B 21/16* (2006.01)
(Continued)

(52) U.S. Cl.
CPC ..... *B63B 21/16* (2013.01); *B63B 21/04* (2013.01); *B63B 27/30* (2013.01); *B63B 59/02* (2013.01); *B63B 39/005* (2013.01); *B63H 25/42* (2013.01)

(58) Field of Classification Search
CPC ..... B63B 21/16; B63B 21/04; B63B 59/02; B63B 21/00
(Continued)

(56) References Cited

U.S. PATENT DOCUMENTS 320,670 A 6/1885 McCabe
2,722,907 A 11/1955 Dyer
(Continued)

FOREIGN PATENT DOCUMENTS

DE 102011051469 10/2012
EP 1695902 8/2006
(Continued)

OTHER PUBLICATIONS

Communication pursuant to Article 94(3) EPC dated Feb. 16, 2015; Application No. 14702942.5; Windcat Workboats Limited.
(Continued)

*Primary Examiner* — Anthony Wiest
(74) *Attorney, Agent, or Firm* — Jeffer Mangels; Butler & Mitchell LLP; Brennan C. Swain, Esq.

(57) ABSTRACT

A method and structure for mooring seaworthy craft against boat landings is disclosed. The structure comprises a fender (4) with a layer of compressible material having an exposed surface, mounted on the craft. Anchor points (12) are secured at laterally spaced locations on the craft, as are two draw mechanisms (14), one associated with each anchor point (12). A tie (10) is provided for extending from each anchor point (12) to its associated draw mechanism (14), and each mechanism is operable to draw its respective tie from
(Continued)

an anchor point around a pylon thereby urging the fender (4) against both pylons. In the mooring process, the craft is first steered to the boat landing to engage the fender (4) against the pylons (6), and the ties (10) are withdrawn from each draw mechanism (14) and taken around one of the pylons. Each tie is then attached to an anchor point (12) on the craft, and the mechanisms (14) are activated to draw the ties (10) around the pylons to urge the fender (4) against them. A control system maintains the required tension in the ties to secure the mooring.

21 Claims, 3 Drawing Sheets

(51) Int. Cl.

| | |
|---|---|
| ***B63B 59/02*** | (2006.01) |
| ***B63B 21/04*** | (2006.01) |
| ***B63B 27/30*** | (2006.01) |
| *B63H 25/42* | (2006.01) |
| *B63B 39/00* | (2006.01) |

(58) Field of Classification Search
USPC ..... 114/230.2, 230.22, 230.23, 230.24, 114/230.26
See application file for complete search history.

(56) References Cited

U.S. PATENT DOCUMENTS

| | | | | |
|---|---|---|---|---|
| 3,300,187 | A | 1/1967 | Saxe | |
| 4,026,234 | A * | 5/1977 | Zbilut | B63B 35/70 114/248 |
| 4,053,185 | A | 10/1977 | Carre | |
| 4,055,137 | A | 10/1977 | Motai et al. | |
| 6,619,223 | B2 * | 9/2003 | Beato | B63B 35/44 114/230.2 |
| 2011/0011321 | A1 | 1/2011 | Marshall | |

FOREIGN PATENT DOCUMENTS

| | | |
|---|---|---|
| EP | 2316721 | 5/2011 |
| EP | 2428442 | 3/2012 |
| EP | 2428442 A1 | 3/2012 |
| EP | 2520485 | 11/2012 |
| GB | 2476858 | 7/2011 |
| KR | 1020110065878 | 6/2011 |
| KR | 20120091816 | 8/2012 |
| KR | 20120091816 A | 8/2012 |

OTHER PUBLICATIONS

GB1301949.2 Search Report dated May 21, 2013 (Windcat Workboats Limited).
CN201480007425.3 Office Action dated Sep. 5, 2016.
KR10-2015-7023147 Office Action dated Oct. 24, 2016.
EP 14702942.5 Office Action dated Apr. 18, 2016.

* cited by examiner

MOORING STRUCTURE MOUNTED ON A VESSEL

This invention relates to systems for mooring ships, boats and other seaworthy craft, and particularly to systems for mooring such a craft against a set of pylons referred to as a boat landing, on a fixed (stationary) or mobile (floating) structure. Known systems for mooring boats against stationary pylons are described in European Patent Specification Nos: 1 695 902; 2 316 721, and 2 520 485; in British Patent Specification No: 2 476 858; and in German Patent Specification No: 10 2011 051 469, the disclosures of all of which are hereby incorporated by reference. The present invention has particular application in offshore wind farms, where turbines are installed on man-made structures, and require regular maintenance, and at boat landings on other offshore structures such as oil and gas platforms. It can also be used in the construction of offshore structures, and in the servicing of ships and floating structures more generally including hotels, restaurants, and supply vessels therefor. Typically such structures have a pair of pylons against which a service boat can be moored during construction and maintenance.

Service boats for use in offshore wind farms commonly have bow structures with a front fender with a layer of compressible material which engages a pair of pylons of the kind described above, when the boat is moored against a turbine structure. The boat can be kept in place by driving the motor to urge the boat against the pylons. However, in these and other circumstances a more direct securement of the boat is desirable, particularly when extensive work has to be carried out.

According to the present invention separate ties are provided to hold the fender of a structure mounted on a seaworthy craft against a set of pylons of the kind forming part of an offshore structure such as those referred to above. Each tie, which can be chain or cable, but preferably comprises strapping, rope or webbing, extends from an anchor point secured on the craft to and around a pylon and back to a draw mechanism also secured on the craft. In some embodiments each tie may comprise a combination of materials, such as a length of rope coupled to a length of strapping; the rope for drawing the strapping around a respective pylon, with the strapping being used to secure the mooring. Each draw mechanism is operable to draw its respective tie around a said pylon to urge the normally straight fender thereagainst, and is preferably laterally spaced from its respective anchor point. While the draw mechanisms can be operated manually, some form of operating system will normally be used.

Structures according to the invention may be part of the craft; on a boat or ship it will normally be a bow structure, or part of an assembly for fitting to a craft. Such an assembly might even be transferable between crafts, or a range of assemblies may be provided for fitting to the same craft, each assembly being particularly adapted to a form of structure against which the craft is to be moored.

A method according to the invention of mooring a seaworthy craft against a pair of pylons on a boat landing, requires the craft to bear a fender with a layer of compressible material having an exposed surface; to have anchor points secured at laterally spaced locations on the craft; and to have two draw mechanisms also secured on the craft for holding ties. The method comprises the steps of:

steering the craft to the boat landing to engage the fender against the pylons;

withdrawing a tie from each of the draw mechanisms and taking it around one of the pylons;

attaching each tie to an anchor point on the craft;

activating the mechanisms to draw the ties around the pylons and urge the fender thereagainst; and controlling the mechanisms to maintain the tension in the ties to secure the mooring.

Separate ties will normally be used, but in some embodiments each tie can be part of a single continuous length of material. This can extend from me anchor point through both draw mechanisms to the other anchor point, or from one draw mechanism to the other. Using a single length of material for the ties complicates the mooring process to a small extent, but can facilitate the monitoring and adjustment of the tension in the ties. On a boat the draw mechanisms are usually located on the deck, with the anchor points below deck level or in the hull, and can be below the waterline.

We have found that with a material such as polyurethane forming the exposed surface of the resilient material on the fender, the engagement of a structure according to the invention can hold the bow of a boat in stable contact with an offshore structure in most normal sea conditions. In preferred embodiments the compressible material of the fender is sufficiently soft to be compressed by engagement with a pylon so that the area of contact between the material and the pylon extends around the circumference of the pylon, typically to around 25 to 40% of it. With pylons 500 mm in diameter and a vertical depth of the resilient material of 300 mm, this can establish a contact area of more than 3000 $cm^2$ with each pylon.

By employing separate draw mechanisms to hold the fender or structure against the pylons, the tension in the respective ties can be individually adjusted to secure and stabilise the mooring of the craft against the various lateral and longitudinal forces to which the craft is exposed. Sensors can be located on the craft for monitoring such forces and particularly lateral forces, which sensors can be operable to generate signals in response to those forces for instructing the draw mechanisms. The draw mechanisms can also be adapted to generate signals indicative of the tension in the respective ties. The tension, and particularly any differential tension, in the ties can provide additional information useful in monitoring the stability of the moored craft. A control system can be installed to monitor these external forces and the tension in the ties, and respond thereto as appropriate. This can be to adjust the tension in one or both ties to resist the external forces or, in extreme circumstances to release the craft from the mooring if the external forces cannot be safely resisted. Such a control system can include an alarm and a delay mechanism to enable operating personnel to reach safety in such a situation before the craft is released.

When the structure is on a boat with a motor, the motor can be kept running as part of the mooring process, and in this variant the operating system for the draw mechanisms can be coupled to the motor in such a manner that the system controls the mechanisms to maintain tension in the ties coupled with whatever drive force is generated by the motor to maintain the requisite pressure between the fender and the pylons. This can be provided by a motor driving either a propeller or a water jet, with the former being preferred.

In structures according to the invention the craft anchor points for the ties and the draw mechanics can all be located at the same level. In this arrangement, the anchor points would be more widely spaced, with the draw mechanisms disposed therebetween. However, a mooring can be better secured by spacing the location of each anchor point vertically from its associated draw mechanism, preferably below it. This results in a length of tie extending diagonally, at an angle to the horizontal or longitudinal axis of the craft, defining a fulcrum, which may not be fixed, facilitating pivoting of the craft by rotation in a vertical plane about the pylons. This enables a craft to respond to movement of the water in which it is floating while putting less overall strain on the ties. If each anchor point is at the same level as its respective draw mechanism, pivoting of the craft about an horizontal axis in either sense simultaneously strains or loosens both tie lengths extending from a pylon. With the anchor points arranged above or below the draw mechanisms, such pivoting of the craft in one sense increases the strain on one length of a tie while reducing the strain on the other length, and vice versa. This differential can be compensated by movement of each tie around the respective pylon. Once again, the preferred arrangement is to have the anchor points more widely spaced than the draw mechanisms. In this arrangement then, the lines of the ties from their anchor points to the associated draw mechanisms are convergent. Normally, the location of the anchor points and the draw mechanisms is symmetric about a vertical axis of the craft.

The invention will now be described by way of example, and with reference to the accompanying schematic drawings wherein.

Figure 1:
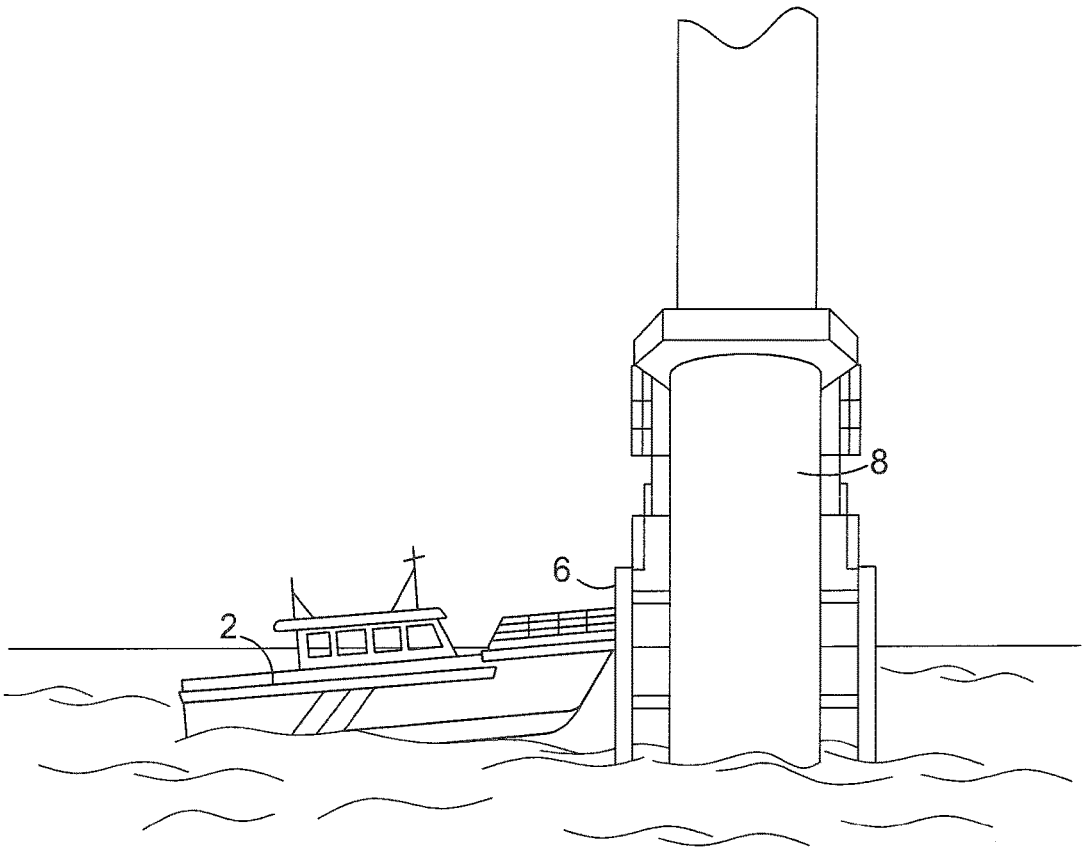
FIG. 1 shows a boat moored against a boat landing on an offshore structure.

FIG. 1 shows a boat 2 moored against pylons 6 forming a boat landing on an offshore turbine structure 8. Access to the structure is then had from the boat deck at its bow onto appropriate fittings on the turbine structure. The boat 2 will typically have a dead weight of around 28 tonnes. In normal seas 4 to 5 tonnes of thrust is required to maintain a boat in stable contact against a boat landing. The present invention can also be exploited on much larger craft; for example a boat having a dead weight of around 100 tonnes requiring a thrust of 20 tonnes or more to maintain engagement with a boat landing. Using a mooring structure as described herein results in considerable fuel savings and of course the savings are greater with a large craft.

Figure 2:
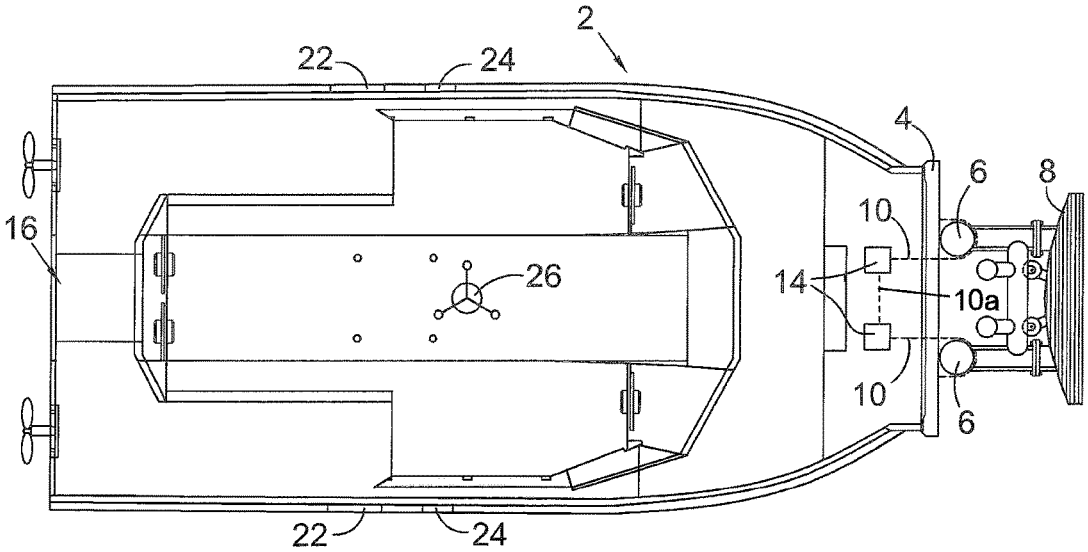
FIG. 2 is a top plan view of a boat having a bow structure according to the invention moored against a boat landing.
Figure 3:
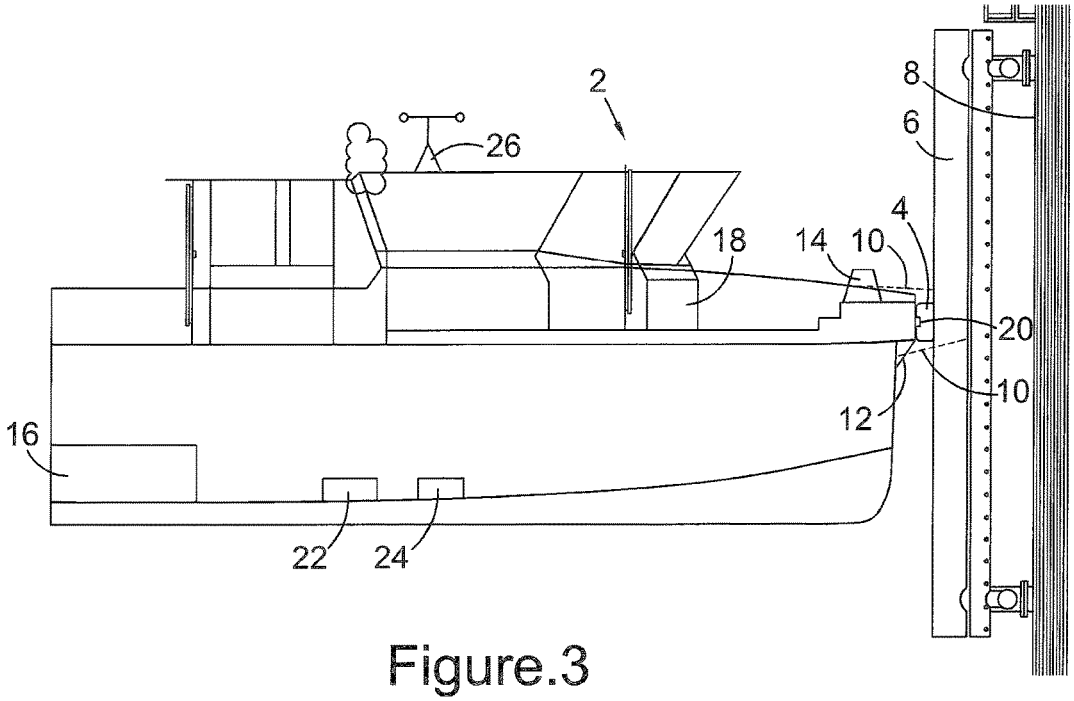
FIG. 3 is a side view of the boat in FIG. 2.
Figure 4:
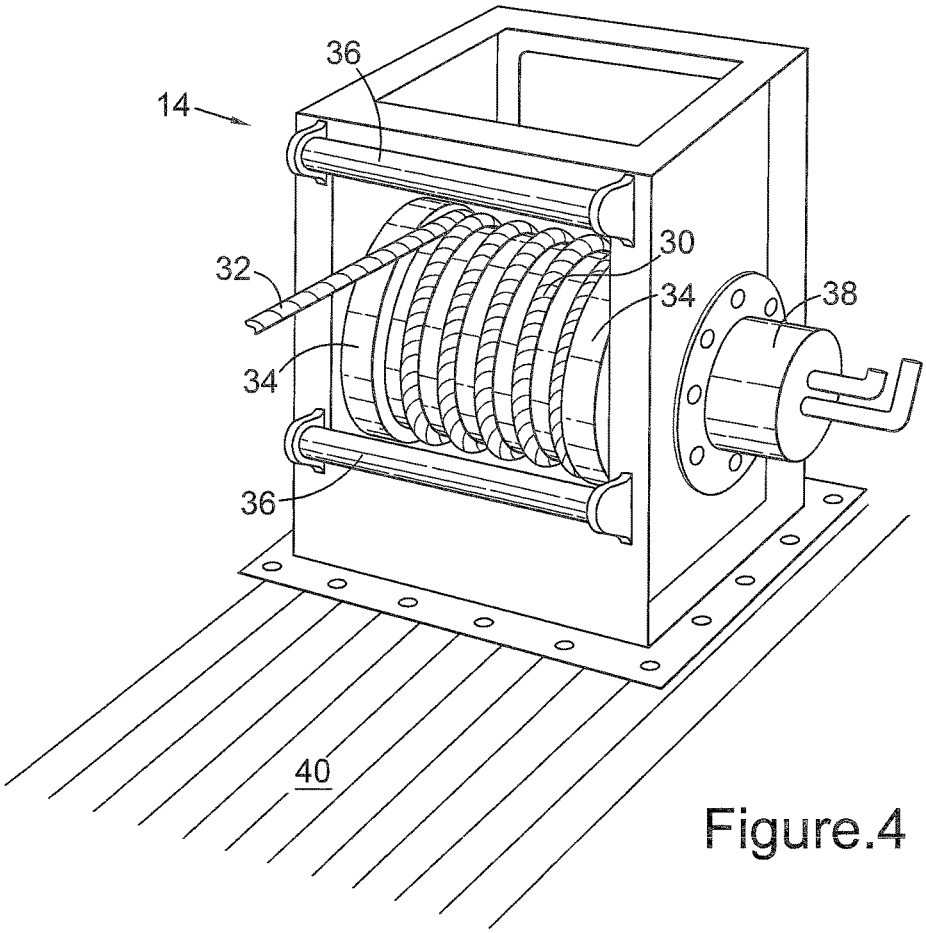
FIG. 4 illustrates a draw mechanism suitable for use in structures of the invention.

The boat 2 shown in FIG. 2 is a twin hulled craft with a fender 4 extending between the two prows of the hulls. The fender illustrated is shown as straight, but can be curved, for example as is shown in FIG. 4 of European specification No. 1 695 902 referred to above. The spacing between the prows of the two hulls, and the length of the fender as shown, is around five meters. In its bow structure the fender 4 includes a layer of compressible material which is shown in engagement with pylons 6 of an offshore turbine structure 8. The compressible material on the fender typically comprises natural or synthetic rubber, and can of course be a combination of different materials. In a preferred embodiment the resilient material comprises a rubber sleeve around a resilient foam core. The resilient material can be secured to the fender by any suitable means, bearing in mind that whatever securement is used has to be water resistant and particularly, resistant to sea water for use offshore. The fender is held in engagement with the pylons by ties 10 which may be ropes, chains, cables, strapping or webbing which extend from anchor points 12 (FIG. 3) around the pylons 6 to draw mechanisms 14. Some preferred structures use ties consisting of a length of rope coupled to a length of strapping. The rope is used to draw the strapping around the respective pylons, and the end of the strapping is then attached to the anchor point with the other end then being hauled in by the draw mechanisms to secure the mooring. The draw mechanisms; for example, winches or rams, may be manually operated, but are normally driven electrically or hydraulically for the reasons discussed below.

The invention can be exploited using conventional fender material extending in horizontal or vertical sections at the bow of a craft. However, a preferred material for use on the fender in a structure of the invention comprises an elastomeric sleeve typically of polyurethane or a similar material, around a core of resilient synthetic foam such as polyethylene. In a particular embodiment such a sleeve has a wall thickness of 40 mm with nylon reinforcement. The core comprises polyurethane foam of density 100 kg/m$^3$. The overall cross-section of the fender can vary, but our preference is that it be of substantially circular or oval outline, with a flat or flattened section against its support on the craft. A typical oval cross-section has a long axis of around 500 mm and a short axis of around 300 m. A section of such a fender is removed to create a flat surface of depth around 40-50 mm generally parallel to the short axis, and mounted on the craft with its long axis aligned with the longitudinal axis of the craft, and the flat surface in engagement with a support on the craft. The flat side can be secured to a support beam by means of adhesive, but additional straps or ties may also be used as a precaution.

As is apparent from the drawings, the anchor points 12 and draw mechanisms 14 are spaced laterally on either side of the longitudinal axis of the boat with the spacing between anchor points 12 being greater than that between the mechanisms 14 such that each free length of each tie extends substantially parallel to the longitudinal axis of the boat. The precise geometry of the draw mechanisms and anchor points is not critical, although it is generally preferred that the anchor points 12 and the winches 14 are located symmetrically on either side of the boat longitudinal axis, and preferably more widely spaced than the spacing between the remote sides of the pylons against which the boat is to be moored. The draw mechanisms can be located closer to each other than the spacing between the proximal sides of the pylons. In this way one or both lengths of each respective tie can extend in a lateral as well as a longitudinal direction. Particularly on a monohull craft, it may be expedient to have the draw mechanisms more widely spaced on the structure than the anchor points on the craft.

As is apparent from FIG. 2, the anchor points 12 are located below their respective draw mechanisms 14. Again, this is not essential, but with the anchor points 12 located in this way the ties provide additional assistance in preventing upward movement of the fender 4 relative to the pylons 6. It also provides resistance to pivotal movement of the boat bout the horizontal axis defined by the fender in engagement with the pylons. The anchor points will then, normally be located below the deck and between the two hulls. They may though be more widely spaced, and be mounted on the hulls. For example, an anchor point may be located at the prow of each hull.

As the boat 2 approaches a turbine structure 8 to be moored, it will normally be driven to engage the fender 4 with the pylons 6 by its motor, indicated at 16. The motor may be kept running to sustain some engagement pressure between the fender 4 and the pylons 6, and once the ties are installed they may be tightened by the draw mechanisms to a tension that in combination with the force of the motor, generates the desired engagement pressure between the fender 4 and the pylons 6. Pressure monitors 20 in the fender can be installed to monitor that engagement pressure.

Draw mechanisms suitable for use in structures of the invention are typically hydraulic winches. Preferred units are hydraulic powered compact aluminium winches with guide rollers. Suitable winches and control systems are available from Armstrong Hydraulic Services Limited of Hull, United Kingdom. Units particularly suitable for use in the structure of the present invention have a low inertia hydraulic motor drive, and are supplied without a brake. The winch barrels are visible, but at the same time guarded to prevent moving parts coming into contact with personnel operating in the same area. FIG. 4 shows a front view of a winch installed on the deck of a boat with a rope extending therefrom for securement around a pylon (6).

As shown in FIG. 4 the winch 14 consists of a metal (steel or aluminium for example) box housing a barrel 30 upon which is wound a length 32 of tie consisting in this preferred embodiment of web strapping coupled to nylon rope. The rope is used to facilitate the installation of the strapping which eventually secures the mooring as described below. However, whole lengths of a single material can be used. Such an alternative is present in FIG. 2. In this alternative the ties are each part of a continuous length of material. The continuous length of material includes a portion 10*a* which extends from one of the draw mechanisms 14 to the other draw mechanism 14. The tie for a particular application can be selected according to the local conditions and of course the craft being used. The box is open to provide access at the top and to the rear, and at the front to provide a path for the tie towards the pylons when the boat is moored. The barrel 30 is formed with flanges 34 to control lateral movement of the rope thereon. Rollers 36 are mounted above and below the front opening, and can also be provided on either side if required. The winch is driven by an hydraulic motor 38, and the entire unit is secured on the deck 40, as indicated. The two winches are powered by the existing hydraulic system of the boat (not shown).

Figure 5:
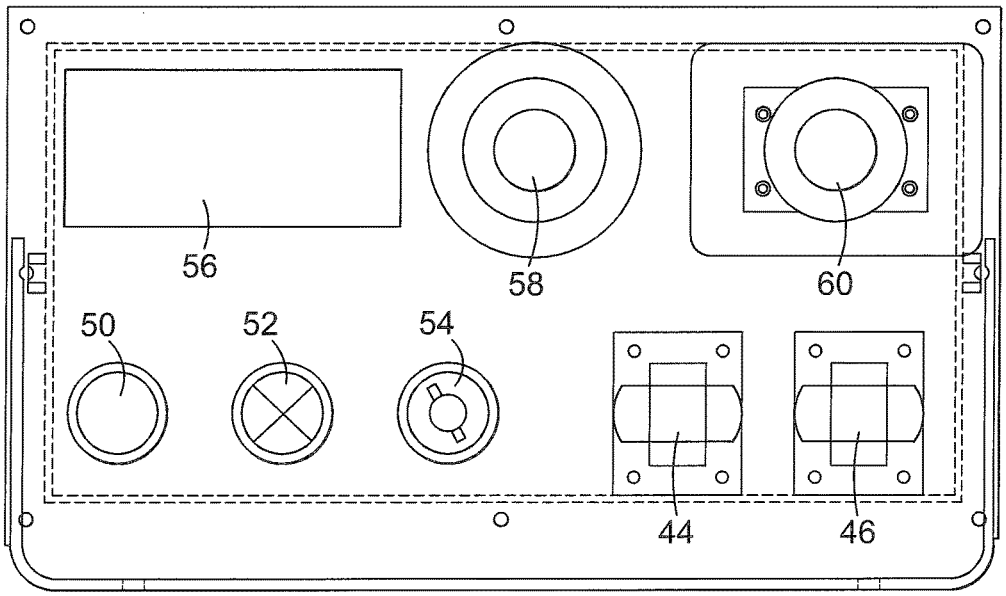
FIG. 5 shows the console of a controller unit for operating the draw mechanisms in structures of the invention.

The two winches are operated from a control station which will typically be located in the wheelhouse of the boat to enable simultaneous control of the vessel's propulsion and steering, as well as the mooring winches. FIG. 5 shows the face of such a controller for use by the operator. It has two joysticks 44 and 46 allowing independent operation of the respective winches, with separate switches to allow such manual operation in their normal mode (50); or to set the winches at a desired rope tension. Unit 54 provides for setting of the desired tension, and the current tension in each tie is indicated on the screen 56. The same tension will normally be maintained in both ropes, but in some circumstances different tensions can be selected to resist unbalanced prevailing forces on the boat. Button 58 is for emergencies, and its activation removes the power from the control system, and the hydraulic power from the winch hydraulic motors. Button 60 provides for quick release of the ties from both winches.

As described above, two winches are mounted on the foredeck of the boat, and are used to moor the boat against two pylons at a boat landing. The boat is driven to the landing and engages the landing with the fender 4 in contact with the two pylons 6. Crew members operate the joysticks 44 and 46 to pay out and take the respective ropes to draw the strapping around the pylons, and the distal end of each length of strapping is coupled to the respective anchor point. A Viking Link Hook attached at each end provides a ready mechanism for coupling the strapping to an anchor point. With the control station in its normal mode (50) each winch is then activated manually by operating its joystick to take up the slack strapping and then the constant tension required in the strapping can be selected (52). The winches then draw the strapping to that tension, which then can be adjusted as required (54). The control unit will then operate to heave in and pay out automatically to maintain the selected constant tension in the strapping. Depending on the operation and sea conditions, the thrust provided by the boat engine urging it against the pylons can be reduced or disengaged during the mooring process, with the mooring secured by the strapping and the winches. This is an important feature which results in significant fuels savings, and also enables the invention to be used in the mooring of crafts against floating structures.

The controller is programmed with a maximum permissible tension in the ties, and the tension in each is continuously monitored. When the tension in either tie reaches or goes beyond that level, both winches will automatically pay out, releasing the boat from the pylons, and leaving the ties attached only to the respective anchor points from which of course they can be retrieved. As the tension in one or other of the ties approaches this pay out level, an audible and/or visual alarm is activated indicating that it is not safe to transfer between the boat and the landing. If for some other reason it is necessary to withdraw the boat quickly from the landing for any other reason, the quick release button 58 can be pressed. This puts the winch barrels 30 into freewheel enabling the boat to move away from the landing without restriction. Again, the released ties remain connected to their respective anchor points for subsequent retrieval.

The preferred controller uses a programmable logic controller (PLC) program to control the hydraulic system. This ensures that all aspects of the system are operational before a function is activated. When in constant tension mode, the PLC monitors the desired securing load and actual load on the winches, and then controls the hydraulic pressure to the winches to maintain the desired securing load. The PLC also activates the alarm referred to above, as necessary.

In offshore structures moored boats are subject to forces from many directions as a consequence of sea movement and wind, and the mooring system of the invention can be adapted to respond to such forces. Wave sensors 22 can be installed as can pressure monitors 24, and a wind sensor 26. Whichever of these are used, signals they generate can be transmitted to the controller 18 which can then indicate what adjustments must be made to the draw mechanisms 14 to maintain the desired pressure between the fender 4 and the pylons 6. If the draw mechanisms are driven electrically or hydraulically, then the computer can directly instruct them to generate the correct tension in the ties.

By monitoring the engagement pressure separately between the fender and each pylon, the system of the invention can provide an indication of weather conditions that make it unsafe to moor the boat against the turbine structure. For example, if the difference in tension between the two ties 10 required to sustain specified contact pressures between the fender and each pylon exceeds a given level, an alarm can be generated. The draw mechanisms 14 can be adapted to automatically release at the same time, or at a given period later, to enable the boat to float freely in the sea and be navigated to safety.

What is claimed is:

1. A structure on a seaworthy craft having a hull and a bow for mooring the craft against a set of elongated pylons, comprising:

a fender with a layer of compressible material having an exposed surface, wherein the fender is secured at a front of the craft, includes an upper surface that defines an upper plane extended, a front surface that defines a front plane extended and a lower surface that defines a lower plane extended, wherein the fender is elongated and has first and second ends;

anchor points secured below the deck at laterally spaced locations on a side of the hull at the bow of the craft and positioned below the lower plane extended of the fender;

two draw mechanisms also secured on the craft and positioned above the upper plane extended of the fender, wherein each draw mechanism is associated with a respective anchor point and laterally spaced from its respective anchor point; and a tie for extending from each anchor point to its associated draw mechanism, wherein each tie extends from the associated draw mechanism at a position located between the first and second ends of the elongated fender, each mechanism being operable to draw its respective tie from an anchor point around a said elongated pylon to urge the fender thereagainst, wherein the structure is configured such that, in use, a length of each tie extends from below the lower plane extended of the fender, through the front plane extended of the fender, around a said elongated pylon diagonally at an angle to a horizontal axis of the craft, through the front plane extended of the fender, and above the upper plane extended of the fender to the associated draw mechanism.

2. A structure according to claim 1, wherein the fender is straight.

3. A structure according to claim 2, wherein the lateral spacing between the draw mechanisms is greater than the lateral spacing between the anchor points.

4. A structure according to claim 1, wherein the location of each anchor point is located below the normal waterline of the craft.

5. A structure according to claim 1, wherein the locations of the anchor points and the draw mechanisms is symmetric about a vertical axis of the craft.

6. A structure according to claim 1, on a boat with a motor, the motor being coupled to the draw mechanisms, including an operating system for the draw mechanisms, which system controls the motor and hence the draw mechanisms to maintain tension in the ties coupled with whatever drive force is generated by the motor to maintain a constant pressure between the fender and the pylons.

7. A structure according to claim 1, including a guide associated with each draw mechanism for guiding the respective tie from the respective pylon to the draw mechanism substantially parallel to the longitudinal axis of the craft.

8. A structure according to claim 1, including an alarm unit for monitoring the tension in the ties, which unit is adapted to generate a signal when the tension in one tie exceeds that in the other tie by an amount in excess of a predetermined value.

9. A structure according to claim 1, wherein the ties are each part of a continuous length of material.

10. A structure according to claim 9, wherein the continuous length of material extends from one of the draw mechanisms to the other draw mechanism.

11. The structure of claim 1 wherein the craft includes a port hull and a starboard hull each having a prow, wherein the fender extends between the prow of the port hull and the prow of the starboard hull, and wherein a first anchor point is located on a front of the prow of the port hull and a second anchor point is located on a front of the prow of the starboard hull.

12. A method of mooring a seaworthy craft having a hull and a bow against a pair of elongated pylons on a boat landing, which craft bears a fender with a layer of compressible material having an exposed surface, wherein the fender is secured at a front of the craft, is elongated and has first and second ends, includes an upper surface that defines an upper plane extended, a front surface that defines a front plane extended and a lower surface that defines a lower plane extended; has anchor points secured at laterally spaced locations on a front of the bow of the hull of the craft that are positioned below the lower plane extended of the fender; and has two draw mechanisms also secured on the craft for holding ties, wherein the two draw mechanisms are positioned above the upper plane extended of the fender, the method comprising the steps of:

steering the craft to the boat landing to engage the fender against the pylons;

extending a tie from each of the draw mechanisms at a position located between the first and second ends of the elongated fender and around one of the pylons and to an associated anchor point on the craft, such that a length of each tie extends from below the lower plane extended of the fender, through the front plane extended of the fender, around a pylon diagonally at an angle to a horizontal axis of the craft, through the front plane extended of the fender, and above the upper plane extended of the fender to the associated draw mechanism;

activating the mechanisms to draw the ties around the pylons to urge the fender thereagainst; and controlling the mechanisms to maintain the tension in the ties to secure the mooring.

13. A method according to claim 12, wherein the craft has a motor, the method including the step of using the motor to drive the craft and engage the fender against the pylons.

14. A method according to claim 13, including the step of controlling the mechanisms while continuing to engage the motor after the draw mechanisms have been activated.

15. A method according to claim 13, including the step of disengaging the motor after the draw mechanisms have been activated.

16. A method according to claim 12, wherein the boat landing is a stationary structure.

17. A method according to claim 12, wherein the boat landing is a floating structure.

18. A method according to claim 12, wherein the arrangement of the draw mechanisms and anchor points on the craft is at least one of the following:

each draw mechanism is laterally spaced from its respective anchor point;

each anchor point on the craft is vertically spaced from its associated draw mechanism;

each anchor point is below its associated draw mechanism;

each anchor point is located below the normal waterline of the craft;

the lateral spacing between the draw mechanisms is less than the lateral spacing between the anchor points; and the locations of the anchor points and the draw mechanisms is symmetric about a vertical axis of the craft.

19. The method of claim 12 wherein the pylons extend below the lower plane extended of the fender and above the upper plane extended of the fender.

20. The method of claim 19 wherein the pylons extend below the waterline.

21. The method of claim 20 wherein the pylons are taller than a roof of the craft.

* * * * *